US011352703B2

(12) United States Patent
Khakpour et al.

(10) Patent No.: US 11,352,703 B2
(45) Date of Patent: Jun. 7, 2022

(54) BIPOLAR EXFOLIATION AND IN-SITU DEPOSITION OF HIGH-QUALITY REDUCED GRAPHENE

(71) Applicants: Iman Khakpour, Miami, FL (US); Amin Rabiei Baboukani, Miami, FL (US); Anis Allagui, Sharjah (AE); Chunlei Wang, Miami, FL (US)

(72) Inventors: Iman Khakpour, Miami, FL (US); Amin Rabiei Baboukani, Miami, FL (US); Anis Allagui, Sharjah (AE); Chunlei Wang, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/234,114

(22) Filed: Apr. 19, 2021

(65) Prior Publication Data

US 2021/0388513 A1 Dec. 16, 2021

Related U.S. Application Data

(60) Provisional application No. 63/037,197, filed on Jun. 10, 2020.

(51) Int. Cl.

| | |
|---|---|
| ***C25B 1/135*** | (2021.01) |
| ***C25B 11/036*** | (2021.01) |
| ***C25B 15/02*** | (2021.01) |
| ***C25B 11/046*** | (2021.01) |
| ***C25B 9/17*** | (2021.01) |
| ***C25B 11/043*** | (2021.01) |

(52) U.S. Cl.

CPC ..... *C25B 1/135* (2021.01); *C25B 9/17* (2021.01); *C25B 11/036* (2021.01); *C25B 11/043* (2021.01); *C25B 11/046* (2021.01); *C25B 15/02* (2013.01)

(58) Field of Classification Search

None

See application file for complete search history.

(56) References Cited

U.S. PATENT DOCUMENTS 10,676,357 B1 * 6/2020 Baboukani ..... C25B 15/02
2014/0097093 A1 * 4/2014 Showalter ..... H02M 3/155 205/341

FOREIGN PATENT DOCUMENTS

WO WO 2020/105646 A1 * 5/2020 ..... C01B 32/19

OTHER PUBLICATIONS

Quezada-Rentería et al, Synthesis of reduced graphene oxide (rGO) films onto carbon steel by cathodic electrophoretic deposition: Anticorrosive coating, Carbon, vol. 122, Jun. 2017, pp. 266-275 (Year: 2017).*

(Continued)

*Primary Examiner* — Harry D Wilkins, III

(74) *Attorney, Agent, or Firm* — Saliwanchik, Lloyd & Eisenschenk

(57) ABSTRACT

Bipolar electrochemistry (BPE) concepts are used to provide a single-step and controllable process for simultaneously exfoliating a graphite source and depositing both graphene oxide and reduced graphene oxide layers on conductive substrates. A bipolar electrochemical cell can be used for a three-in-one deposition and can include two wired pieces of graphite to monitor the amount of current that passes through the bipolar electrode.

20 Claims, 6 Drawing Sheets

(56) References Cited

OTHER PUBLICATIONS

Fosdick et al, Bipolar Electrochemistry, Angewandte Chemie, vol. 52, No. 40, Sep. 2013, pp. 10438-10456 (Year: 2013).*

Khakpour et al, Bipolar Exfoliation and in Situ Deposition of High-Quality Graphene for Supercapacitor Application, ACS Applied Energy Materials, vol. 2, No. 7, Jun. 2019, pp. 4813-4820 (Year: 2019).*

Allagui et al, Reduced Graphene Oxide Thin Film on Conductive Substrates by Bipolar Electrochemistry, Scientific Reports, vol. 6, No. 21282, Feb. 2016, pp. 1-7 (Year: 2016).*

* cited by examiner

BIPOLAR EXFOLIATION AND IN-SITU DEPOSITION OF HIGH-QUALITY REDUCED GRAPHENE

CROSS-REFERENCE TO RELATED APPLICATION

This application claims the benefit of U.S. Provisional Application Ser. No. 63/037,197, filed Jun. 10, 2020, which is hereby incorporated by reference herein in its entirety, including any figures, tables, and drawings.

BACKGROUND

Since its discovery by the scotch tape method, graphene, which is comprised of a single, two dimensional layer of $sp^2$-bonded carbon atoms arranged in a hexagonal lattice, has attracted growing interest due to its unique properties such as high surface area, high thermal conductivity, high charge carrier mobility, high optical transparency, broad electrochemical window, and unconventional superconductivity. Many approaches have been demonstrated to produce graphene-based materials, which can be divided into top-down and bottom-up approaches. The top-down methods involve breaking the stacked layers of graphene in graphite into single or multi-layer graphene sheets, whereas the bottom-up methods consist of arranging carbon atoms on a substrate yielding the formation of two dimensional carbon structures. The production of high-quality graphene has been reported by means of bottom-up approaches like chemical vapor deposition (CVD) and epitaxial growth of graphene. However, expensive vacuum and heating systems are usually involved, which has decreased their popularity in many scale-up applications.

Commercially-available graphene/graphene oxide (GO) materials are mostly produced based on top-down wet chemical and/or electrochemical approaches for (i) exfoliation of GO from graphite sources and (ii) reduction of exfoliated GO into graphene or reduced graphene oxide (rGO). In the wet chemical processes such as Hummers method and modified Hummers method, strong oxidizing agents like $KMnO_4$, $NaNO_3$, and $KClO_3$ in a strong acidic medium are typically used for the production of GO, and strong reducing agents such as hydrazine, hydrohalic acid, and L-ascorbic acid are typically used for the formation of rGO. These sets of reactions can introduce relatively high amounts of defects into the rGO sheets and produce toxic chemicals like $ClO_2$ and $NO_2$. Graphene samples analyzed from different suppliers worldwide indicate that the quality of the graphene produced today is not optimal for applications. The majority of commercially-available materials are actually graphite microplates with less than 10% graphene content, and none of the samples have more than 50% graphene content. On the other hand, the electrochemical techniques have been increasingly employed in graphene mass production with the advantages of high production yield of relatively high purity products in simple and cost-effective ways. The electrochemical approaches are typically based on intercalating molecules or charged ions (i.e., anionic or cationic species) between the graphene layers of a graphite electrode to facilitate the exfoliation and collection of the graphene nanosheets from the solution. Although the anodic approach is more common due to the higher efficiency of intercalation and expansion, the cathodic exfoliation is more desired in order to avoid unwanted chemical functionalization and damage to the graphite basal plane that occur during the anodic exfoliation.

BRIEF SUMMARY

Embodiments of the subject invention use bipolar electrochemistry (BPE) concepts to provide a single-step and controllable process for simultaneously exfoliating a graphite source and depositing both graphene oxide and reduced graphene oxide layers on conductive substrates. A bipolar electrochemical cell can be used for a three-in-one deposition and can include two wired pieces of graphite to monitor the amount of current that passes through the bipolar electrode. Upon the application of the direct current (DC) voltage across the feeding electrodes (e.g., stainless steel feeding electrodes), several electrochemical processes take place, resulting in a three-in-one in situ exfoliation, reduction, and deposition in a single step and in an environmental friendly manner to directly form functional graphene-based electrodes.

In an embodiment, a system for a three-in-one in situ exfoliation, reduction, and deposition of graphene oxide and reduced graphene oxide can comprise: a solution; a negative feeding electrode and a positive feeding electrode disposed in the solution; and a first bipolar electrode and a second bipolar electrode disposed in the solution, the first bipolar electrode and the second bipolar electrode being disposed between (e.g., in a lateral or horizontal direction parallel to a bottom surface of a container containing the solution) the negative feeding electrode and the positive feeding electrode. The first bipolar electrode can be a first piece of graphite and/or the second bipolar electrode can be a second piece of graphite. The solution can be water (e.g., deionized water, such as deionized water with no additives). The negative feeding electrode can be a stainless steel electrode and/or the positive feeding electrode can be a stainless steel electrode. The first bipolar electrode and the second bipolar electrode can be configured to measure a bipolar current in the solution. The first bipolar electrode and the second bipolar electrode can be disposed, for example, about 7 centimeters (cm) apart from each other. The negative feeding electrode and the positive feeding electrode can be disposed, for example, about 9 cm apart from each other. The system can further comprise a voltage source connected to the negative feeding electrode and the positive feeding electrode and capable of supplying a voltage (e.g., a direct current (DC) voltage), for example, of 45 Volts (V) or at least 45 Volts (V).

In another embodiment, a method for simultaneously exfoliating a graphite source and depositing both graphene oxide and reduced graphene oxide layers on a conductive substrate can comprise: a) providing a system for three-in-one in situ exfoliation, reduction, and deposition, the system comprising: a solution; a negative feeding electrode and a positive feeding electrode disposed in the solution; a voltage source connected to the negative feeding electrode and the positive feeding electrode (e.g., configured to supply a voltage (e.g., a DC voltage), for example, of 45 V or at least 45 V); and a first bipolar electrode and a second bipolar electrode disposed in the solution, the first bipolar electrode and the second bipolar electrode being disposed between (e.g., in a lateral or horizontal direction parallel to a bottom surface of a container containing the solution) the negative feeding electrode and the positive feeding electrode (the first bipolar electrode can be a first piece of graphite and/or the second bipolar electrode can be a second piece of graphite); and b) supplying, by the voltage source, a voltage to the system such that: graphene oxide is exfoliated from at least one of the first bipolar electrode and the second bipolar electrode; at least some of the graphene oxide is reduced; and graphene oxide and reduced graphene oxide are deposited on at least one of the negative feeding electrode and the positive feeding electrode. The solution can be water (e.g., deionized water, such as deionized water with no additives). The negative feeding electrode can be a stainless steel electrode and/or the positive feeding electrode can be a stainless steel electrode. The first bipolar electrode and the second bipolar electrode can be configured to measure a bipolar current in the solution. The first bipolar electrode and the second bipolar electrode can be disposed, for example, about 7 centimeters (cm) apart from each other. The negative feeding electrode and the positive feeding electrode can be disposed, for example, about 9 cm apart from each other. The method can further comprise measuring, by the first bipolar electrode and the second bipolar electrode, a bipolar current in the solution. The graphene oxide and reduced graphene oxide can be deposited on the positive feeding electrode and the negative feeding electrode, respectively.

BRIEF DESCRIPTION OF DRAWINGS

FIG. 1(*b*) shows an equivalent resistance circuit of the cell of the setup in FIG. 1(*a*). The resistances $R_{C/S}$, $R_{A/S}$, $R_{G/S}$, and $R_{S/G}$ represent the charge transfer resistances of the surface reactions at the cathode feeding electrode, anode feeding electrode, partially negative side of the bipolar electrode, and partially positive side of the bipolar electrode, respectively. $R_A$ is the sum of resistances of both bipolar electrodes, wirings, and the amperemeter, which is negligible. $R_{S1}$, $R_{S2}$, and $R_{S3}$ denote the solution resistances between the stainless steel anode and bipolar graphite, bipolar graphite and stainless steel cathode, and between the two stainless steel electrodes, respectively.

FIG. 1(*c*) shows a plot of current (in milliamps (mA)) versus time (in hours (h)), showing a change of total current, bipolar current (path 1), and solution current (path 2, calculated by subtracting the bipolar current from the total current) during the bipolar electrochemical process.

FIG. 2(*b*) shows Raman spectra of produced materials deposited on the positive electrode and the negative electrode.

FIG. 2(*c*) shows X-ray diffraction (XRD) patterns of produced materials deposited on the positive electrode and the negative electrode.

FIG. 3(*b*) shows an SEM image of deposited graphene on the negative electrode. The scale bar is 100 nanometers (nm).

FIG. 3(*c*) shows a transmission electron microscope (TEM) image of deposited graphene on the negative electrode. The scale bar is 200 nm for the main image. The inset of FIG. 3(*c*) shows selected area electron diffraction patterns of the graphene on the negative electrode; the scale bar is 20 $nm^{-1}$ for the inset. The outer circled (green) spots are related <2110> planes, and the inner circled (red) spots are related to <1100> planes.

FIG. 3(*d*) shows an SEM image of deposited graphene on the positive electrode. The scale bar is 1 μm.

FIG. 3(*e*) shows an SEM image of deposited graphene on the positive electrode. The scale bar is 100 nm.

FIG. 3(*f*) shows a high resolution TEM (HRTEM) image of deposited graphene on the negative electrode. The scale bar is 5 nm.

FIG. 4(*b*) is a plot showing capacitance (in $mF/cm^2$) versus voltage (in V), showing cyclic voltammetry results of the positive electrode at different scan rates. The curve with the highest value at 0.4 V is for 2 millivolts per second (mV/s); the curve with the second-highest value at 0.4 V is for 10 mV/s; the curve with the third highest value at 0.4 V is for 100 mV/s; and the curve with the fourth-highest value at 0.4 V is for 1000 mV/s.

FIG. 4(*c*) is a plot showing average capacitance (in $mF/cm^2$) versus scan rate (in millivolts per second (mV/s)), showing the average areal capacitance of the negative and positive electrodes calculated from the voltammetry measurements at different scan rates.

FIG. 4(*d*) is a plot showing voltage (in V) versus time (in seconds (s)), showing constant-current charging/discharging results for negative electrode based devices. The curve that peaks at the lowest time is for 250 microamps per square centimeter ($\mu A/cm^2$); the curve that peaks at the second-lowest time is for 100 $\mu A/cm^2$; the curve that peaks at the third-lowest time is for 50 $\mu A/cm^2$; and the curve that peaks at the highest-lowest time is for 25 $\mu A/cm^2$.

FIG. 4(*e*) is a plot showing voltage (in V) versus time (in s), showing constant-current charging/discharging results for positive electrode based devices. The curve that peaks at the lowest time is for 250 microamps per square centimeter ($\mu A/cm^2$); the curve that peaks at the second-lowest time is for 100 $\mu A/cm^2$; the curve that peaks at the third-lowest time is for 50 $\mu A/cm^2$; and the curve that peaks at the highest-lowest time is for 25 $\mu A/cm^2$.

FIG. 4(*f*) is a plot showing average discharging capacitance (in $mF/cm^2$) versus cycle number at different charge/discharge currents for both negative electrode based devices and positive electrode based devices.

FIG. 5(*b*) is a plot of impedance phase angle plot versus log of frequency (in Hertz (Hz)) for a negative electrode electric double layer capacitor (EDLC) and a positive electrode EDLC. The curve with the highest value at 0 Hertz (Hz) is for the negative electrode; and the curve with the lowest value at 0 Hz is for the positive electrode.

FIG. 5(*c*) is a plot of effective capacitance (in $mF/cm^2$) versus effective resistance (in kΩ) for a negative electrode electric double layer capacitor (EDLC) and a positive electrode EDLC. The curve with the highest value at 10 kΩ is for the negative electrode; and the curve with the lowest value at 10 kΩ is for the positive electrode.

FIG. 5(*d*) is a plot of voltage (in V) versus time (in s), showing smoothing capability of the negative electrode based EDLC device in a full wave rectifier circuit compared to a commercial 100 microFarad (μF) aluminum electrolytic capacitor.

DETAILED DESCRIPTION

Figures 1A, 1B, 1C:
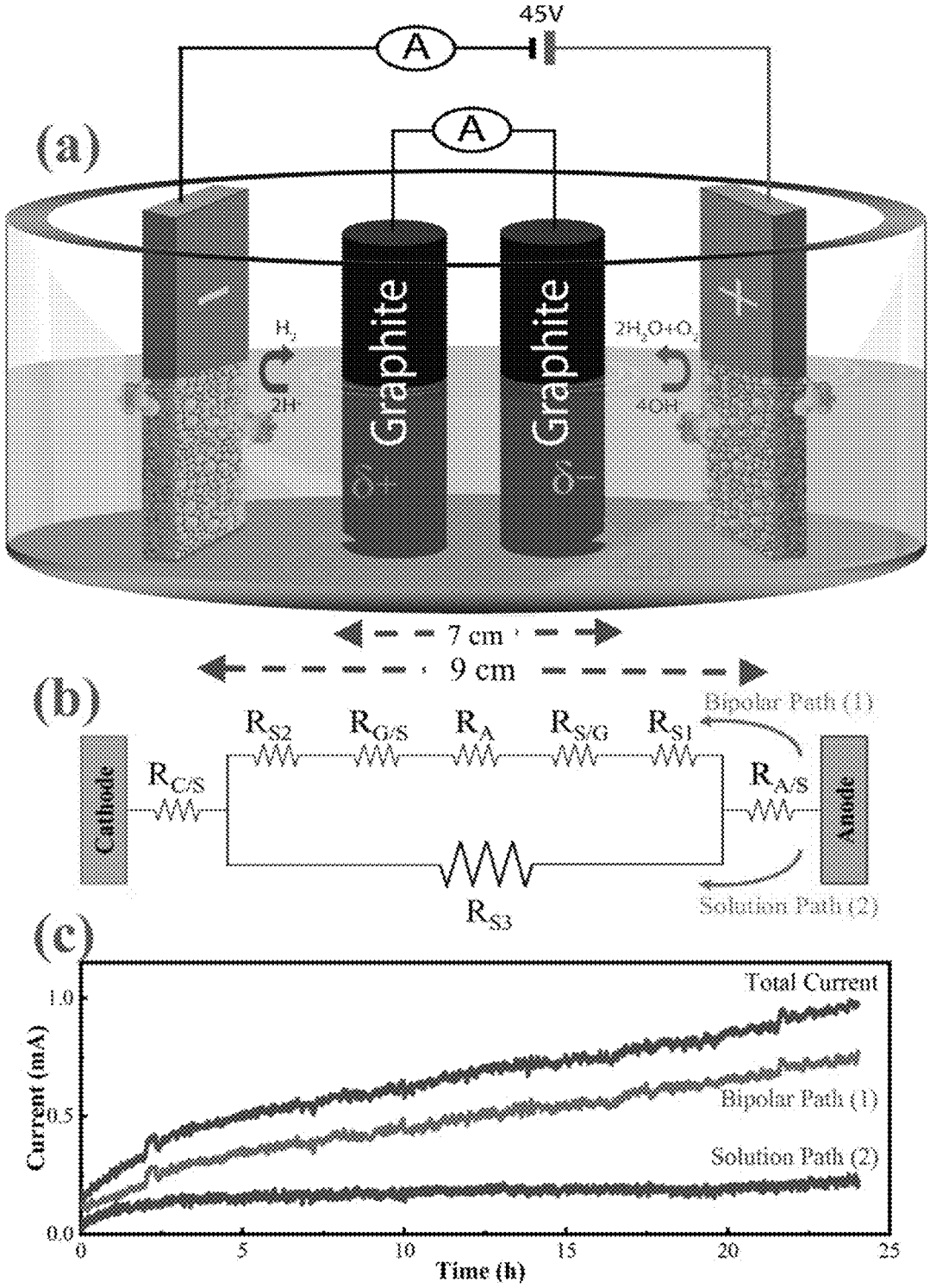
FIG. 1(*a*) shows a schematic view of a bipolar electrochemical setup, according to an embodiment of the subject invention.

Embodiments of the subject invention use bipolar electrochemistry (BPE) concepts to provide a single-step and controllable process for simultaneously exfoliating a graphite source and depositing both graphene oxide and reduced graphene oxide layers on conductive substrates. A bipolar electrochemical cell can be used for a three-in-one deposition and can include two wired pieces of graphite to monitor the amount of current that passes through the bipolar electrode. Upon the application of the direct current (DC) voltage across the feeding electrodes (e.g., stainless steel feeding electrodes), several electrical processes take place, resulting in a three-in-one in situ exfoliation, reduction, and deposition in a single step and in an environmental friendly manner to form directly functional graphene-based electrodes.

While related art top-down approaches can successfully produce graphene oxide (GO) from graphite, which then necessitates further steps of reduction or reduction/deposition of GO to form reduced GO (rGO), none of them can spontaneously combine exfoliation, reduction, and deposition in a single step and in an environmental friendly manner to form directly functional graphene-based electrodes. An unconventional deposition approach can be used to exfoliate and partially reduce GO oxide using a BPE method. The bipolar electrochemical cell can include a graphite rod placed equidistantly between two feeding electrodes in a low conductivity solution. The formation and deposition of partially reduced GO on the positive feeding electrode can be achieved with promising areal capacitance of 55 microFarads per square centimeter ($\mu Fcm^{-2}$) at a scan rate of 10 millivolts per second ($mVs^{-1}$). BPE has been around since the 1960s and refers to an approach to generate asymmetric reactions on a conductive object in a wireless fashion. BPE has found many applications in electrosynthesis and microanalysis due to its advantages of low cost, ease of operation, and simple instrumentation. Because oxidation occurs on one side of the conductive subject in BPE, while the reduction occurs simultaneously on the other side, it is worthwhile to further examine any possible material formation on the negative feeding electrode.

Embodiments of the subject invention provide modified BPE approaches that can exfoliate a graphite source electrode and deposit few-layer graphene materials on conductive substrates. Material characterization confirmed the successful exfoliation and deposition of GO and rGO on the positive and negative electrodes, respectively. The electrochemical performance of the electrodes showed a specific capacitance of at least 1.932 $mF/cm^2$, a cutoff frequency at −45 degrees, and an impedance angle of 1820 Hz, which is adaptable for alternative current (AC) line filters. The results demonstrate the feasibility and scalability of the three-in-one approach for in situ exfoliation, reduction, and deposition (i.e., single-step in situ exfoliation, reduction, and deposition) of high surface area rGO with outstanding electrochemical performance.

Development of reliable, simple, cost-efficient, and eco-friendly methods for scale-up production of high-quality graphene-based materials is important for the broad applications of graphene. Embodiments of the subject invention use bipolar electrochemistry concepts to provide a single-step and controllable process for simultaneously exfoliating a graphite source and depositing both graphene oxide and reduced graphene oxide layers on conductive substrates. The electrochemical analysis carried out on symmetric cells revealed good areal capacitance for the high-quality reduced graphene oxide deposited on the negative feeding electrode, and for the graphene oxide deposited on the positive feeding electrode. The devices also showed high stability for periodic and repeated constant current charging/discharging cycles, which is suitable for energy storage in supercapacitors. The devices also show the capability to be used for AC filtering applications, as confirmed by frequency domain results.

Figure 6:
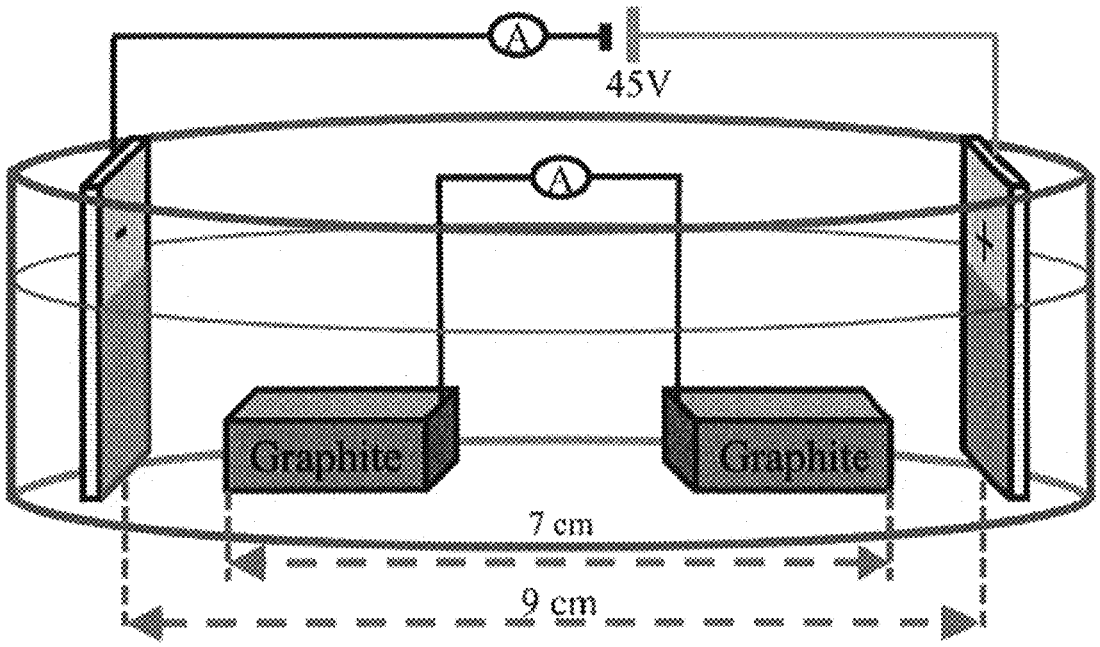
FIG. 6 shows a schematic view of a bipolar electrochemical setup, according to an embodiment of the subject invention.

Each of FIG. 1(*a*) and FIG. 6 shows a schematic view of a bipolar electrochemical setup, according to an embodiment of the subject invention. Although FIGS. 1(*a*) and 6 show the electrodes as being 9 centimeters (cm) apart from each other, this is for exemplary purposes only and should not be construed as limiting. Similarly, although FIGS. 1(*a*) and 6 show the graphite pieces as being disposed 7 cm apart from each other, this is for exemplary purposes only and should not be construed as limiting. Also, although FIGS. 1(*a*) and 6 show a voltage of 45 V applied to the electrodes, this is for exemplary purposes only and should not be construed as limiting. FIG. 1(*b*) shows an equivalent resistance circuit of the cell of the setup in FIG. 1(*a*). The resistances $R_{C/S}$, $R_{A/S}$, $R_{G/S}$, and $R_{S/G}$ represent the charge transfer resistances of the surface reactions at the cathode feeding electrode, anode feeding electrode, partially negative side of the bipolar electrode, and partially positive side of the bipolar electrode, respectively. $R_A$ is the sum of resistances of both bipolar electrodes, wirings, and the amperemeter, which is negligible. $R_{S1}$, $R_{S2}$, and $R_{S3}$ denote the solution resistances between the stainless steel anode and bipolar graphite, bipolar graphite and stainless steel cathode, and between the two stainless steel electrodes, respectively. FIG. 1(*c*) shows a plot of current (in mA) versus time (in hours (h)), showing a change of total current, bipolar current (path 1), and solution current (path 2, calculated by subtracting the bipolar current from the total current) during the bipolar electrochemical process.

Referring to FIG. 1(*a*), the bipolar electrochemical cell can be used for a three-in-one deposition of rGO on a conductive substrate. Unlike the conventional bipolar setup, in embodiments of the subject invention two wired pieces of graphite can be used in order to monitor the amount of current that passes through the bipolar electrode. Upon the application of the direct current (DC) voltage across the feeding electrodes (e.g., stainless steel feeding electrodes), several electrical processes take place that can be seen from the equivalent circuit shown in FIG. 1(*b*).

The resistances between the two feeding electrodes are the resistance of the bipolar path (1), and the resistance of the solution path (2) (non-bipolar path), which are in parallel. The resistances of the bipolar path (1) include the charge transfer resistance $R_{C/S}$ of the surface reactions at the cathode feeding electrode, charge transfer resistance $R_{A/S}$ between anode feeding electrode and solution, charge transfer resistances $R_{G/S}$ and $R_{S/G}$, which are related to the partially negative side of the bipolar electrode and the partially positive side of the bipolar electrode, respectively, as well as $R_{S1}$ and $R_{S2}$, which are the solution resistances between the feeding electrodes and the two pieces of graphite. The solution resistance $R_{S3}$ is the resistance between the two feeding electrodes. All the solution resistances, $R_{S1}$, $R_{S2}$, and $R_{S3}$, should be proportional to the distance between the electrodes after the BPE is stabilized. Therefore, $R_{S1}$ and $R_{S2}$ should be 9 times smaller than $R_{S3}$ according to the cell design. Compared to the above resistances, $R_A$, which is the sum of the resistances of both bipolar electrodes, wirings, and the amperemeter, is negligible.

The total current flowing through the cell (FIG. 1(*c*)) is the sum of the currents passing through the bipolar path (1) and solution path (2). For the first two hours, the increase of currents of the path (1) and path (2) is most likely due to surface activation and nucleation. The total and bipolar currents increase with time while the current of the path (2) remains almost constant after the initial 2 hours. This demonstrates that in the growth stage the increase in the bipolar current causes the increase in the total current, which can be explained as follows. Because the current of the solution path (2) is a function of $R_{A/S}$, $R_{S3}$, and $R_{C/S}$ and it does not change with time, these resistances are most likely constant in the growth stage. In addition, because $R_{S1}$ and $R_{S2}$ are proportional to $R_{S3}$, $R_{S1}$ and $R_{S2}$ can also be considered to remain constant in the growth stage. Thus, the increase of the bipolar current with time in growth stage indicates that the sum of $R_{S/G}+R_{G/S}$ decreases with time given that $R_A$ is negligible. These two charge transfer resistances are related to reactions that happen on the farthest points of the bipolar electrodes, which are subjected to 35 V apparent potential difference (which is proportional to the distance). These reactions are the oxidation and reduction of water, and the exfoliation of graphite. Assuming the kinetics of water electrolysis to be stable with time, in the growth stage the increase in bipolar current can be attributed to the acceleration of the exfoliation process. Because the conductivity of the solution was not increased with time, corrosion induced ionic dissolution of the feeding electrodes is very negligible.

After deposition, a thick film on the positive electrode and a thin film on the negative electrode can be visualized. The deposition of graphene on the negative electrode by means of bipolar electrochemistry of carbon has not been observed in related art systems or methods.

Figures 2A, 2B, 2C:
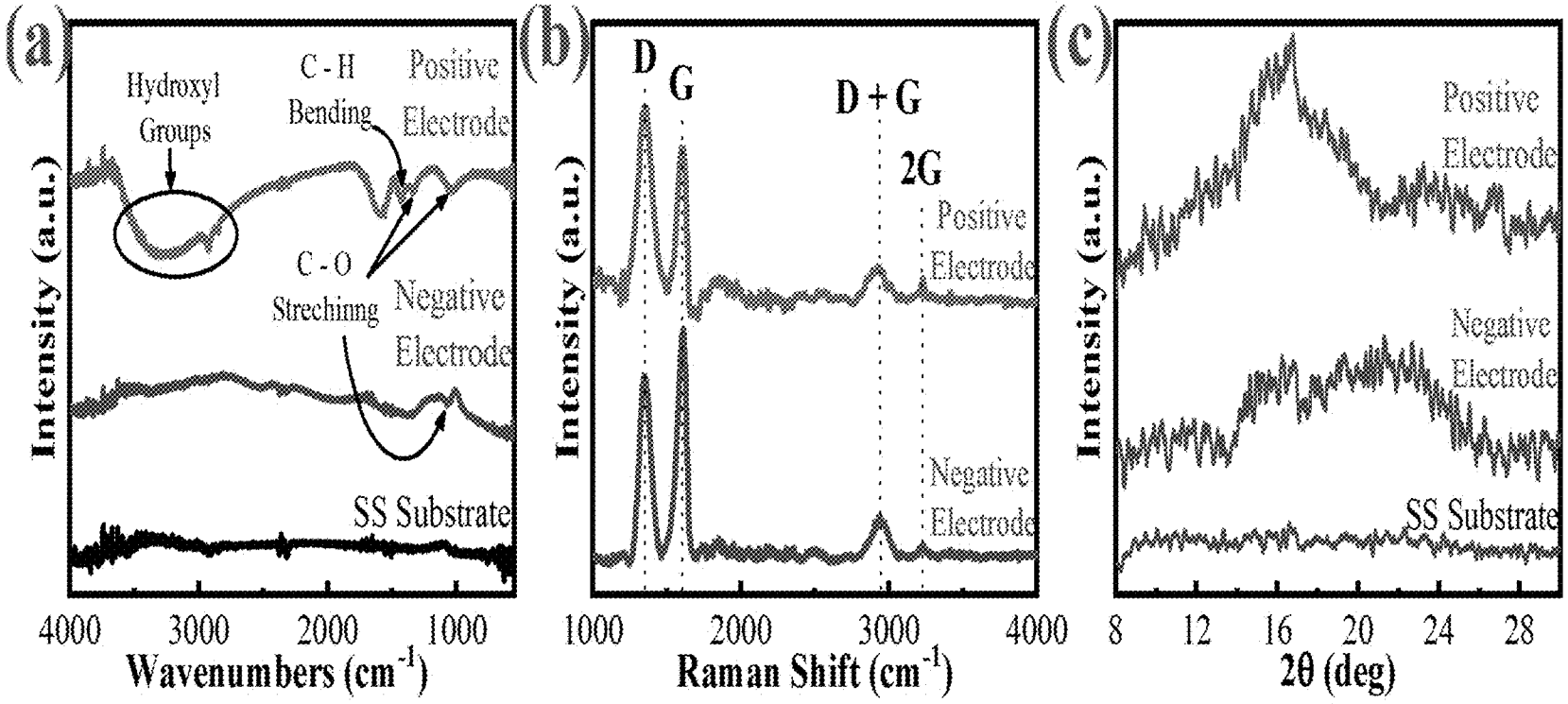
FIG. 2(*a*) shows Fourier-transform infrared spectroscopy (FTIR) spectra of produced materials deposited on the positive electrode, the negative electrode, and the substrate.

FIG. 2(*a*) shows Fourier-transform infrared spectroscopy (FTIR) spectra of produced materials deposited on the positive electrode, the negative electrode, and the substrate. FIG. 2(*b*) shows Raman spectra of produced materials deposited on the positive electrode and the negative electrode. FIG. 2(*c*) shows X-ray diffraction (XRD) patterns of produced materials deposited on the positive electrode and the negative electrode. Referring to FIG. 2(*a*), the FTIR technique was performed to evaluate the functional groups of the samples deposited on both the positive and negative electrodes. The broad absorption peak around 3340 $cm^{-1}$ for the positive electrode signals the presence of hydroxyl groups. The other significant peaks for the positive electrode were detected at 1600 $cm^{-1}$ and 1430 $cm^{-1}$, which are attributed to aromatic C═C stretching and C—H bending, respectively. The peaks at around 1330 $cm^{-1}$ and 1040 $cm^{-1}$ are ascribed to C—O stretching bands. The presence of these functional groups shows that the deposited material is mostly GO. In contrast, there are fewer functional groups in the FTIR spectrum for the negative electrode in terms of peak numbers and intensities, indicating the level of oxidation for the material on the negative electrode is lower compared to the positive one. X-ray photoelectron spectroscopy (XPS) was also performed in order to study the chemical composition and bonding structure of formed materials. The C1s peak can be fitted into three peaks that are sp2 (284.5 eV) bonded carbon, sp3 (285.4 eV) bonded carbon, and carbonyl (C═O) functional group (287.7 eV). The area of the C═O peak is about 16.5% out of the total area of C1s.

Referring to FIG. 2(*b*), prominent Raman peaks, typical for graphene-based materials, were detected in both samples. The D-band centered at around 1350 $cm^{-1}$, G-band at around 1609 $cm^{-1}$, D+G peak around 2910 $cm^{-1}$, and 2G-band at around 3200 $cm^{-1}$. The spectra also reveal that the ratio $I_D/I_G$ obtained from the positive electrode is almost 60% higher than that from the negative electrode, which means that the graphene on the negative electrode has fewer structural defects and is in a more reduced state when compared to the graphene on the positive electrode.

Referring to the X-ray diffraction (XRD) patterns in FIG. 2(*c*), broad diffraction bands centered around 170 for the positive electrode and around 20° for the negative electrode can be observed. According to Bragg's law of diffraction ($n\lambda=2d \sin \theta$, n=1, $\lambda$=1.54056 Å), the diffraction angle (2θ) of the (002) planes in pure graphite is 26.5° with an interlayer spacing of 3.35 Å. A diffraction angle of 11.4° is for fully oxidized GO. It indicates the formation of partially reduced GO coating on both negative and positive electrodes. Further, as the broad peak for the negative electrode shifted to higher values, this indicated that a higher level of reduction occurred on the negative electrode. The reduction process is more favorable on the negative electrode of the cell, so the production of highly reduced GO is more probable on the negative electrode than on the positive electrode. In addition, the exfoliation of graphene/graphene oxide can happen on both anodic and cathodic sides of the bipolar electrode. The hydrogen and oxygen production can also occur due to water electrolysis, but the amount of generated gases, which is proportional to the electric charge, should be relatively small considering the low time-averaged cell current in FIG. 1(*c*).

Figures 3A, 3B, 3C, 3D, 3E, 3F:
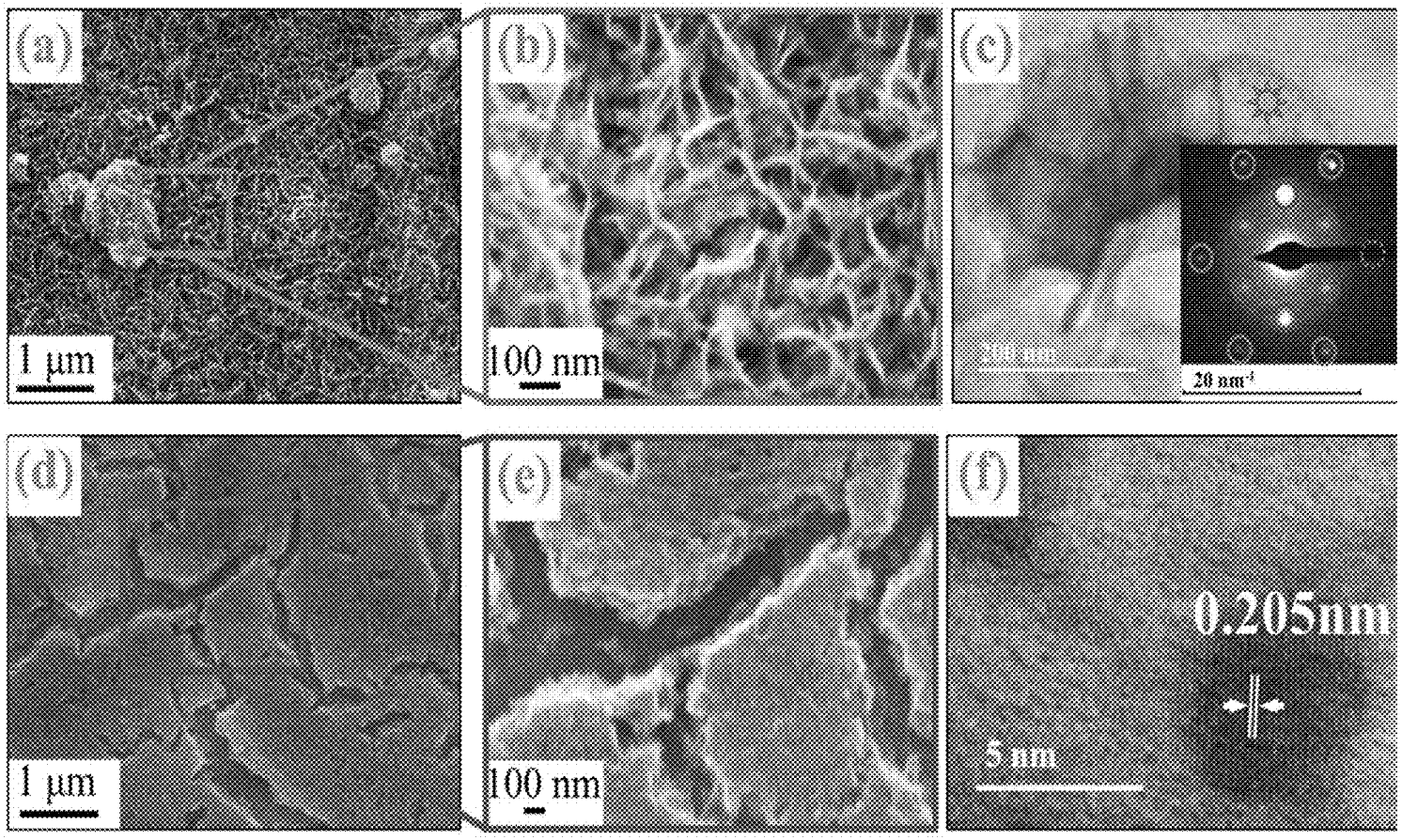
FIG. 3(*a*) shows a scanning electron microscope (SEM) image of deposited graphene on the negative electrode. The scale bar is 1 micrometer (μm).

FIGS. 3(*a*), 3(*b*), 3(*d*), and 3(*e*) show scanning electron microscope (SEM) micrographs of the surface of the negative (FIGS. 3(*a*) and 3(*b*)) and positive (FIGS. 3(*d*) and 3(*e*)) electrodes after 24 hours of the BPE process. The material formed on the negative electrode has a porous vertically aligned structure with a pore size of around 100 nanometers (nm), which could be more favorable for high surface area energy storage applications. The cross-sectional SEM image reveals that the deposition rate on the negative feeding electrode is about 10 nm per hour (nm/h). In contrast, the graphene on the positive side has a bulky flat structure with deep cracks indicating preferential restacking in the growth stage. The transmission electron microscope (TEM) image and selected area electron diffraction (SAED) patterns of the graphene on the negative electrode are shown in FIGS. 3(*c*) and 3(*f*). The thin graphene sheets examined (with some folds or overlaps) of about 400 nm size are formed after 12 hours deposition on the surface of TEM mesh. Single crystalline SAED patterns confirm the formation of low defected graphene sheets. Due to the absence of additional diffraction spots except those for corresponding to the graphite structure, no superlattice-type ordered arrays were observed with or without any oxygen-containing functional groups present, which proves that the deposited graphene is highly reduced and pure. In addition, in graphene-based materials when the number of stacked layers is more than one layer, the intensity of spots diffracted from <2$\bar{1}$10> planes will be higher than the ones from <1$\bar{1}$00>. In the SAED pattern of FIG. 3(*c*), the green marked spots (related to <2$\bar{1}$10> planes) have a lower intensity than the red marked spots (related to <1$\bar{1}$00> planes), which indicates that the examined graphene is most likely a single layer graphene. Interplanar spacing (d-spacing) of 0.205 nm can be extracted from the high resolution TEM (HRTEM) image shown in FIG. 3(*f*), which is smaller than the typical d-spacing of GO.

Figures 4A, 4B, 4C, 4D, 4E, 4F:
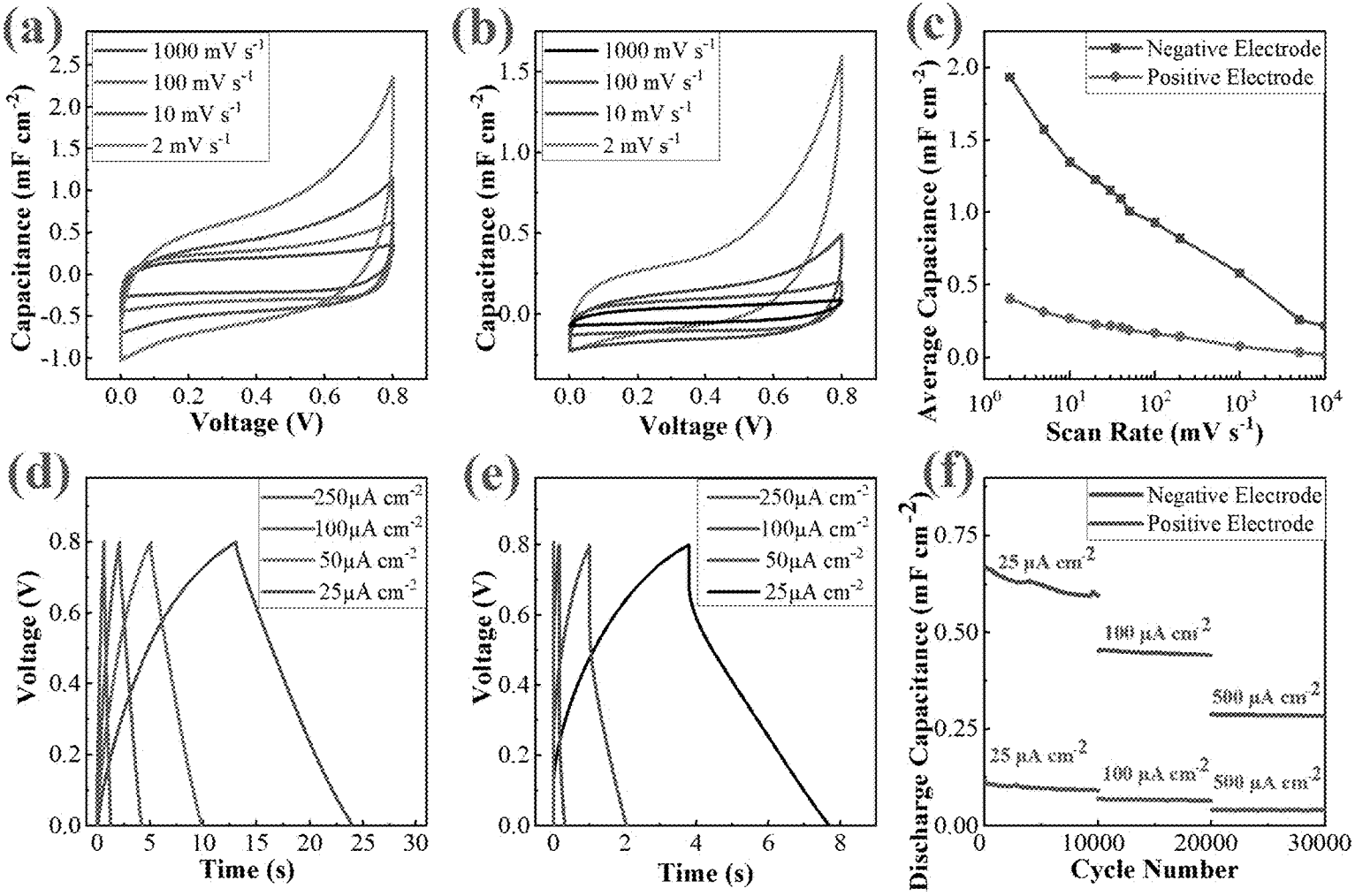
FIG. 4(*a*) is a plot showing capacitance (in milliFarads per square centimeter ($mF/cm^2$)) versus voltage (in Volts (V)), showing cyclic voltammetry results of the negative electrode at different scan rates. The curve with the highest value at 0.4 V is for 2 millivolts per second (mV/s); the curve with the second-highest value at 0.4 V is for 10 mV/s; the curve with the third highest value at 0.4 V is for 100 mV/s; and the curve with the fourth-highest value at 0.4 V is for 1000 mV/s.

Considering the unique surface and structural properties of the binderless graphene-based materials deposited by BPE, their performance for electrical energy storage in supercapacitors was investigated. FIGS. 4(*a*) and 4(*b*) show the results for the negative and positive electrodes, respectively, where the y-axis current has been normalized with respect to the scan rate so that it reads directly the areal device capacitance in mF/cm$^2$ as a function of voltage. The cyclic voltammetry (CV) curves are almost rectangular in shape at different scan rates, which demonstrates an electric double-layer capacitor (EDLC) behavior for both devices. The symmetry of the curves with respect to the zero y-axis shows the excellent reversibility of both devices. The average areal capacitance over the voltage window computed from the CV measurements using:

$$C = \frac{1}{2v\Delta V}\int i(V)dV \tag{1}$$

is plotted in FIG. 4 (*c*) as a function of the voltage scan rate v. In Equation (1) V, i, and ΔV are the applied voltage, measured current, and voltage window, respectively. Comparing the values in FIG. 4(*c*) reveals that capacitances decrease with the increase of scan rate for both devices, which is a typical behavior for EDLCs. The capacitance of the negative electrode based device is much higher than that of the positive electrode based device; at 2 mV/s the areal capacitance of the negative electrode based device is about 4 times that of the positive electrode based device, and at 10 V/s it is about 2 times larger.

The performance of these devices was also studied by galvanostatic charge/discharge (GCD) test, as shown in FIGS. 4(*d*) and 4(*e*). The electrical behavior of the device based on negative electrodes is closer to that of a capacitor because its GCD curves are highly symmetric and linear with negligible ohmic losses, while the device based on positive electrodes showed more deviation from ideal capacitor given the asymmetry and nonlinearity of the GCD curves and the high ohmic drops. The average areal capacitance of the devices was calculated for different currents and reported in Table 1 using:

$$C = \frac{1}{\Delta V}\int i_{dc}dt \tag{2}$$

In Equation, $i_{dc}$ is the discharge current and ΔV is the voltage window of 0.8 V. Rate capability tests were conducted for both devices and the results are presented in FIG. 4(*f*). Both devices show excellent stability up to 30,000 cycles. It can be seen that for the device based on negative electrodes the discharge capacitances are around 0.6 mF/cm$^2$ (10000th cycle) and 0.3 mF/cm$^2$ (30000th cycle) at 25 μA/cm$^2$ and 500 μA/cm$^2$, respectively, while for the device based on positive electrodes the discharge capacitances are around 0.1 mF/cm$^2$ (10000th cycle) and 0.04 mF/cm$^2$ (30000th cycle) at the same rates. The higher capacitance and good rate capability of the negative electrode based device can be attributed to the unique porous structure with higher surface area and a higher level of reduction of the rGO as demonstrated from SEM/TEM, FTIR, Raman, and XRD results herein.

TABLE 1

Discharge capacitances of negative and positive electrode based devices at different current rates.

| Discharge Current (μA cm$^{-2}$) | 25 | 50 | 100 | 250 | 500 |
|---|---|---|---|---|---|
| Negative Electrode Discharge Capacitance (μF cm$^{-2}$) | 702.8 | 599.5 | 512.6 | 405.8 | 323.0 |
| Positive Electrode Discharge Capacitance (μF cm$^{-2}$) | 245.5 | 154.8 | 64.9 | 4.5 | 4.4 |

Figures 5A, 5B, 5C, 5D:
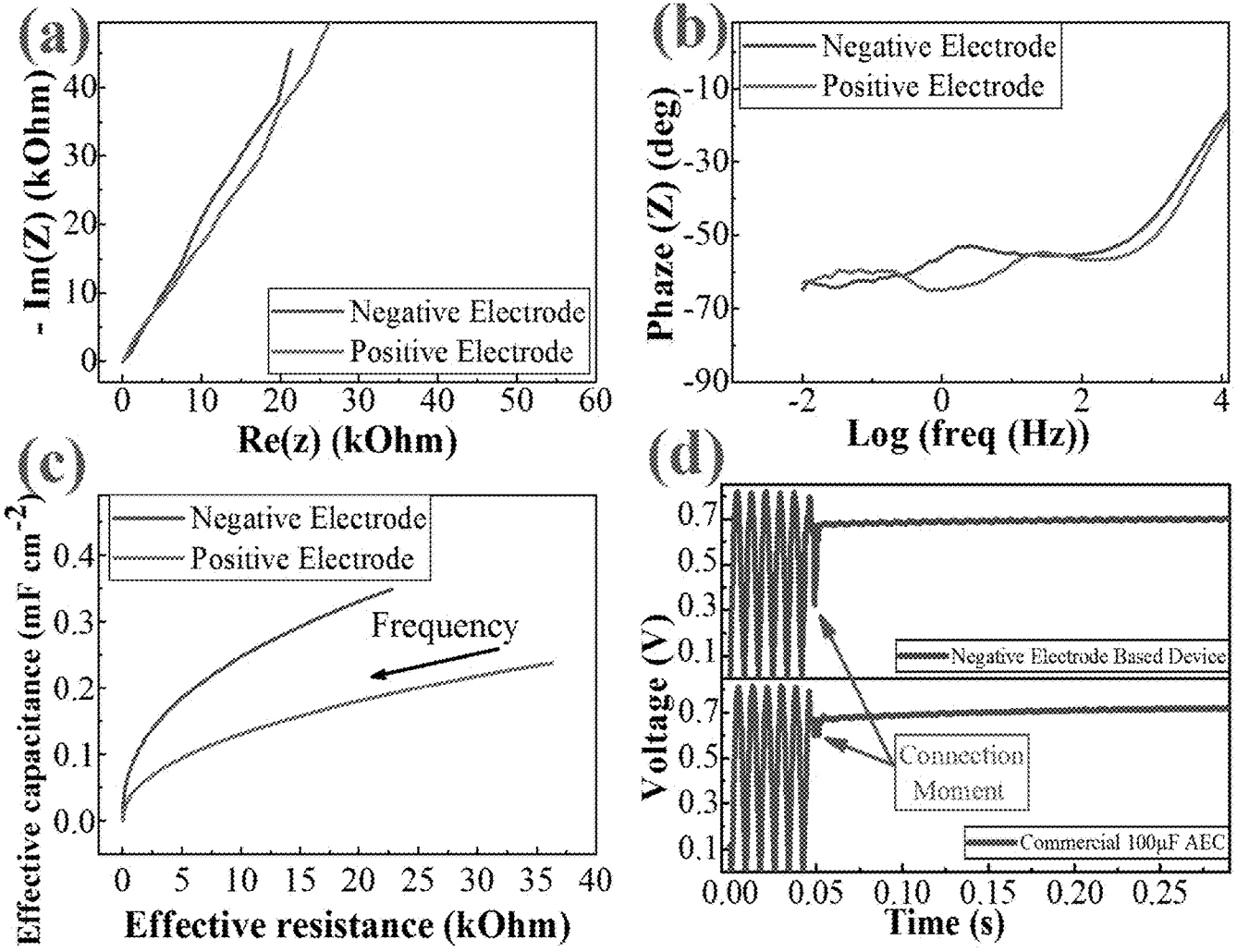
FIG. 5(*a*) is a plot of the complex-plane representation of imaginary versus real part of capacitance for a negative electrode electric double layer capacitor (EDLC) and a positive electrode EDLC. The curve with the highest value at 10 kilo-Ohms (kΩ) is for the negative electrode; and the curve with the lowest value at 10 kΩ is for the positive electrode.

The devices were analyzed using electrochemical impedance spectroscopy, and the results are presented in FIGS. 5(*a*)-5(*d*). From the complex-plane representation of real vs. imaginary of impedance shown in FIG. 5(*a*) and impedance phase angle plot as a function of frequency shown in FIG. 5(*b*), it can be seen that the responses of both devices deviate from that of ideal capacitors. An ideal capacitor is expected to show a constant −90° phase angle between the real and imaginary parts of impedance independently of the frequency and voltage. However, the impedance angles of both devices are relatively stable from 10 mHz to 100 Hz; i.e., −60.3° ($R^2$=0.561) and −58.2° ($R^2$=0.862) for the positive and negative electrode based devices, respectively. Nonetheless, despite the deviation from ideal capacitor behavior, devices with similar responses were shown to be favorable for non-DC applications such as AC line filtering and low-frequency oscillators. Then, as the frequency is increased, the impedance angles tend quickly towards a resistive behavior as shown in FIG. 5(*b*). An angle of −45° at which the magnitude of resistance and reactance are equal is found to be at the frequencies of 1820 Hz and 1157 Hz for the positive and negative electrode based devices, respectively. This extended capacitive behavior can be attributed to the two-dimensional structure of the active electrode materials, which facilitate fast charging and discharging of the devices.

To evaluate the performance metrics of the two devices, the impedance data have been modeled using a resistor ($R_s$) in series with a constant phase element (CPE). The CPE has a fractional-order impedance given by $Z_{CPE}(s)=1/C_\alpha(j\omega)^\alpha$, where Cα (in units of F $s^{\alpha-1}$) and α ($0<\alpha<1$) are the CPE parameter and CPE exponent respectively, and $(j\omega)^\alpha=\omega^\alpha[\cos(\alpha\pi/2)+j\sin(\alpha\pi/2)]$[22, 37-38]. The phase angle of a CPE is constant and is equal to −απ/2, which makes it an intermediary element depicting intermediary behaviors between ideal capacitors and resistors. The impedance fitting parameters ($R_s$; $C_\alpha$; α) for the positive electrode-based device (over the frequency range 48 kHz (intercept with Im(Z)=0) to 10 mHz) and the negative electrode based device (over the frequency range 61 kHz to 10 mHz) were computed using complex nonlinear least-squares minimization and found to be (10.92Ω, 0.087 mF $s^{\alpha-1}$, 0.683) and (11.28Ω, 0.138 mF $s^{\alpha-1}$, 0.705), respectively. An effective frequency-dependent capacitance ($C_{eff}$) in Farads and frequency-dependent resistance ($R_{eff}$) in Ohms can be computed by writing Equation (3), which leads to Equations (4) and (5) as follows:

$$Z = R_s + \frac{1}{(j\omega)^{\alpha} C_{\alpha}} = R_{eff} + \frac{1}{j\omega C_{eff}} \quad (3)$$

$$C_{eff} = \frac{\omega^{(\alpha-1)} C_{\alpha}}{\sin(\alpha\pi/2)} \quad (4)$$

$$R_{eff} = R_s + \frac{\cos(\alpha\pi/2)}{\omega^{\alpha} C_{\alpha}} \quad (5)$$

Instead of representing the real vs. imaginary of impedance as depicted in FIG. 5(*a*), the performance of the devices can be represented using a plot of $C_{eff}$ versus $R_{eff}$ as shown in FIG. 5(*c*). It can be seen from FIG. 5(*c*) that in terms of energy storage in the frequency-domain the negative electrode based device outperforms the positive electrode based device, again attributed to the favorable structure of its electrodes materials for fast and effective electrical charge storage and ionic movement. Also, the existence of a capacitance (even small) at high frequencies with low effective resistance makes both devices suitable for filtering applications. For instance, at 120 Hz, ($C_{eff}$, $R_{eff}$) were found to be about (22.2 μF $cm^{-2}$, 42.6Ω) and (12.3 μF $cm^{-2}$, 72.2Ω) for the negative electrode based device and the positive electrode based device, respectively.

Practical application of the EDLC as an AC line filter was studied and compared with a commercial aluminum electrolytic capacitor (AEC). For this purpose, a sinusoidal wave (60 Hz, $V_{peak}$=+1V) was applied to an AC filter circuit using a four-Schottky-diodes bridge rectifier and a 39 kΩ resistor as the load. The voltage output without using smoothing EDLC was a pulsing full wave rectified signal (120 Hz, $V_{peak}$=+0.82V), which is shown in FIG. 5(*d*). After the negative electrode based EDLC was connected to the filter circuit, the pulsing signal was flattened to 0.728 V. The same test was also conducted by using a 100 μF AEC; a DC signal of 0.735 V was obtained. These results demonstrate the excellent AC filtering function of EDLC of embodiments of the subject invention, which are comparable to commercial AECs.

Referring to the electrochemical results, the specific capacitance of EDLCs fabricated by BPE at a negative feeding electrode was ~2 mF/$cm^2$ at the scan rate of 2 mV/s and ~0.7 mF/$cm^2$ at a discharge current of 25 μA/$cm^2$, which is comparable with related art EDLCs. The areal capacitance is in the range of 0.021 to 2 mF/$cm^2$ for few layer graphene based materials at the same or even lower scan rates or discharge currents. Considering the capability of the three-in-one exfoliation, deposition, and reduction process according to embodiments of the subject invention, along with the high performance and high stability of the assembled devices, BPE according to embodiments of the subject invention is an advantageous technique for production of graphene-based EDLCs. BPE according to embodiments of the subject invention is environmentally-friendly and simple to operate, because it takes place at a low temperature (e.g., room temperature) using water (e.g., deionized water without any additives or any other chemicals). Further, compared to other materials synthesis methods using three-electrode systems or high-temperature/high-pressure reactors, BPE uses simple instrumentation (e.g., a single DC power supply). Different types and quantities of conductive materials can be coated simultaneously in one cell, which makes the BPE techniques of embodiments of the subject invention ideal for scale-up manufacturing of graphene based devices.

Embodiments of the subject invention provide three-in-one exfoliation, reduction, and deposition of graphene-based materials via BPE processes. Embodiments of the subject invention have applications in a wide variety of fields, including but not limited to use as an electrode for energy storage devices including batteries and supercapacitors, optoelectronic applications, sensors, micro and/or flexible devices, and/or biomedical applications. By evaluating the total and bipolar current in the fabrication process, it can be seen that the exfoliation of graphite is promoted with time. Highly reduced graphene layers with porous structure were formed on the negative electrode. The electrochemical characterization revealed that the electrode has a high areal capacitance (~2 mF/$cm^2$ at the scan rate of 2 mV/s and ~0.7 mF/$cm^2$ at a discharge current of 25 μA/$cm^2$) with long-term cyclability, which is important for supercapacitor applications. The device performance at high frequencies showed good results for AC filtering of leftover ripples. Different types and quantities of conductive substrate materials can be coated at once, which makes these techniques ideal for scaling up purposes.

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Materials and Methods

Graphite rods (3 cm in length and 6.15 mm in diameter, Ultra "F" Purity 99.9995%) were purchased from Alfa Aesar. Two 2×1 $cm^2$ 316 stainless steel electrodes, placed 9 cm apart in deionized water, were used as the feeding electrodes for bipolar electrochemical setup of this study (see FIGS. 1(*a*) and 6). Knowing that the ratio of the bipolar current to the total current is equal to the ratio of solution resistance by the sum of solution resistance plus bipolar electrode resistance, a high resistance solution would promote more faradic current through the floating graphite, which justifies the use of deionized water. A multi-channel Agilent Technologies N6705A DC Power Analyzer was used for applying a DC voltage of 45 V across the stainless steel electrodes for 24 hours, which resulted in an apparent electric field of 5 V/cm. The applied voltage and current were recorded as a function of time. In order to record the amount of bipolar current, two pieces of graphite rod serving as bipolar electrodes were connected to another channel of the power analyzer at current measuring mode.

Low resolution and high resolution electron micrographs of the deposited materials were obtained using a JEOL SEM 6330 and a Philips CM-200 FEG TEM, respectively. Copper (Cu) mesh was attached to the negative electrode for 12 hours deposition in order to collect the deposited materials for TEM. The X-ray diffraction patterns were obtained using a Siemens D-5000 diffractometer (with Cu Kα radiation; λ=0.154056 nm). Fourier transform infrared spectroscopy was carried out on a JASCO FT/IR 4100 in order to study the functional groups of materials. Raman scattering measurements were performed in the backscattering configuration using a 514 nm laser source to study the defects and the degree of reduction of the deposited materials. X-ray photoelectron spectroscopy was performed to study the chemical composition of deposited material on negative feeding electrode using a Physical Electronics 5400 ESCA instrument (with Al Kα radiation).

The electrochemical characterizations of the materials were carried out in a two-electrode configuration using a VMP3 Bio-Logic multichannel potentiostat. Two symmetrical devices based one on the materials formed on positive feeding electrodes and another on those formed on the negative feeding electrodes were assembled in Swagelok cells. 1 mole per liter (mol/L) $Na_2SO_4$ solution was used as the electrolyte, and Celgards 2400 microporous polypropylene was used as a separator. All the electrochemical parameters were normalized with the geometric footprint area of the electrodes. Time-domain cyclic voltammetry (CV), galvanostatic charge/discharge (GCD), and frequency-domain electrochemical impedance spectroscopy (EIS) were used to evaluate the electrochemical properties of the fabricated devices. The spectral impedances of the devices were measured at 0 V DC with 10 mV-amplitude sinusoidal voltage of frequency varying from 1 MHz down to 1 mHz. The CV was conducted at different scan rates from 2 mV/s to 10000 mV/s in the voltage window of 0 V to 0.8 V. Different loading currents from 25 $\mu A/cm^2$ to 500 $\mu A/cm^2$ were used in the GCD analysis.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A system for a three-in-one in situ exfoliation, reduction, and deposition of graphene oxide and reduced graphene oxide, the system comprising:

a solution;

a negative feeding electrode and a positive feeding electrode disposed in the solution;

a first bipolar electrode and a second bipolar electrode disposed in the solution, the first bipolar electrode and the second bipolar electrode being disposed between the negative feeding electrode and the positive feeding electrode; and a power analyzer applying a voltage across the positive feeding electrode and the negative feeding electrode, the first bipolar electrode being a first piece of graphite, the second bipolar electrode being a second piece of graphite, the first bipolar electrode being disposed closer to the negative feeding electrode than is the second bipolar electrode, the second bipolar electrode being disposed closer to the positive feeding electrode than is the first bipolar electrode, the first bipolar electrode comprising a first surface facing the negative feeding electrode, the second bipolar electrode comprising a second surface facing the positive feeding electrode, a distance between the first surface of the first bipolar electrode and the second surface of the second bipolar electrode being greater than both a distance between the first surface of the first bipolar electrode and the negative feeding electrode and a distance between the second surface of the second bipolar electrode and the positive feeding electrode, the positive feeding electrode and the negative feeding electrode being connected to a first channel of the power analyzer, and the first bipolar electrode and the second bipolar electrode being connected to a second channel of the power analyzer different from the first channel.

2. The system according to claim 1, the solution being water.

3. The system according to claim 1, the solution being deionized water with no additives.

4. The system according to claim 1, the negative feeding electrode being a stainless steel electrode.

5. The system according to claim 4, the positive feeding electrode being a stainless steel electrode.

6. The system according to claim 1, the positive feeding electrode being a stainless steel electrode.

7. The system according to claim 1, the first bipolar electrode and the second bipolar electrode being configured to measure a bipolar current in the solution.

8. The system according to claim 1, the first surface of the first bipolar electrode and the second surface of the second bipolar electrode being disposed about 7 centimeters (cm) apart from each other.

9. The system according to claim 1, the negative feeding electrode and the positive feeding electrode being disposed about 9 cm apart from each other.

10. The system according to claim 1, further comprising a voltage source connected to the negative feeding electrode and the positive feeding electrode and capable of supplying a direct current (DC) voltage of at least 45 Volts (V).

11. A method for simultaneously exfoliating a graphite source and depositing both graphene oxide and reduced graphene oxide layers on a conductive substrate, the method comprising:

providing a system for three-in-one in situ exfoliation, reduction, and deposition, the system comprising:

a solution;

a negative feeding electrode and a positive feeding electrode disposed in the solution;

a voltage source connected to the negative feeding electrode and the positive feeding electrode; and a first bipolar electrode and a second bipolar electrode disposed in the solution, the first bipolar electrode and the second bipolar electrode being disposed between the negative feeding electrode and the positive feeding electrode, the first bipolar electrode being a first piece of graphite, and the second bipolar electrode being a second piece of graphite; and supplying, by the voltage source, a voltage to the system such that: graphene oxide is exfoliated from at least one of the first bipolar electrode and the second bipolar electrode; at least some of the graphene oxide is reduced; and graphene oxide and reduced graphene oxide are deposited on at least one of the negative feeding electrode and the positive feeding electrode, the first bipolar electrode being disposed closer to the negative feeding electrode than is the second bipolar electrode, the second bipolar electrode being disposed closer to the positive feeding electrode than is the first bipolar electrode, the first bipolar electrode comprising a first surface facing the negative feeding electrode, the second bipolar electrode comprising a second surface facing the positive feeding electrode, a distance between the first surface of the first bipolar electrode and the second surface of the second bipolar electrode being greater than both a distance between the first surface of the first bipolar electrode and the negative feeding electrode and a distance between the second surface of the second bipolar electrode and the positive feeding electrode, the voltage source being a power analyzer, the positive feeding electrode and the negative feeding electrode being connected to a first channel of the power analyzer, and the first bipolar electrode and the second bipolar electrode being connected to a second channel of the power analyzer different from the first channel.

12. The method according to claim 11, the solution being water.

13. The method according to claim 11, the solution being deionized water with no additives.

14. The method according to claim 11, the negative feeding electrode being a stainless steel electrode.

15. The method according to claim 14, the positive feeding electrode being a stainless steel electrode.

16. The method according to claim 11, the positive feeding electrode being a stainless steel electrode.

17. The method according to claim 11, further comprising measuring, by the first bipolar electrode and the second bipolar electrode, a bipolar current in the solution.

18. The method according to claim 11, the first surface of the first bipolar electrode and the second surface of the second bipolar electrode being disposed about 7 centimeters (cm) apart from each other, and the negative feeding electrode and the positive feeding electrode being disposed about 9 cm apart from each other.

19. The method according to claim 11, the graphene oxide being deposited on at least the positive feeding electrode, and the reduced graphene oxide being deposited on at least the negative feeding electrode.

20. A method for simultaneously exfoliating a graphite source and depositing both graphene oxide and reduced graphene oxide layers on a conductive substrate, the method comprising:

providing a system for three-in-one in situ exfoliation, reduction, and deposition, the system comprising:

a solution;

a negative feeding electrode and a positive feeding electrode disposed in the solution;

a voltage source connected to the negative feeding electrode and the positive feeding electrode; and a first bipolar electrode and a second bipolar electrode disposed in the solution, the first bipolar electrode and the second bipolar electrode being disposed between the negative feeding electrode and the positive feeding electrode, the first bipolar electrode being a first piece of graphite, and the second bipolar electrode being a second piece of graphite;

supplying, by the voltage source, a voltage to the system such that: graphene oxide is exfoliated from at least one of the first bipolar electrode and the second bipolar electrode; at least some of the graphene oxide is reduced; and graphene oxide and reduced graphene oxide are deposited on the positive feeding electrode and the negative feeding electrode, respectively; and measuring, by the first bipolar electrode and the second bipolar electrode, a bipolar current in the solution, the solution being deionized water with no additives, the negative feeding electrode being a stainless steel electrode, the positive feeding electrode being a stainless steel electrode, the first bipolar electrode being disposed closer to the negative feeding electrode than is the second bipolar electrode, the second bipolar electrode being disposed closer to the positive feeding electrode than is the first bipolar electrode, the first bipolar electrode comprising a first surface facing the negative feeding electrode, the second bipolar electrode comprising a second surface facing the positive feeding electrode, a distance between the first surface of the first bipolar electrode and the second surface of the second bipolar electrode being greater than both a distance between the first surface of the first bipolar electrode and the negative feeding electrode and a distance between the second surface of the second bipolar electrode and the positive feeding electrode, the voltage source being a power analyzer, the positive feeding electrode and the negative feeding electrode being connected to a first channel of the power analyzer, and the first bipolar electrode and the second bipolar electrode being connected to a second channel of the power analyzer different from the first channel.

* * * * *